United States Patent [19]

Senoue et al.

[11] Patent Number: 4,653,130

[45] Date of Patent: Mar. 31, 1987

[54] BEDSORE PREVENTING APPARATUS

[75] Inventors: Masaharu Senoue; Haruhiko Naruse, both of Kadoma, Japan

[73] Assignee: Matsushita Electric Works, Ltd., Osaka, Japan

[21] Appl. No.: 675,761

[22] Filed: Nov. 28, 1984

[51] Int. Cl.[4] ..... A61G 7/04; A47C 27/10

[52] U.S. Cl. ..... 5/453; 5/469; 137/565; 137/624.18

[58] Field of Search ..... 5/453, 455, 456, 469; 137/624.18, 565; 128/33

[56] References Cited

U.S. PATENT DOCUMENTS

| | | | |
|---|---|---|---|
| 2,719,986 | 10/1955 | Rand | 5/453 |
| 2,998,817 | 9/1961 | Armstrong | 5/453 |
| 3,148,391 | 9/1964 | Whitney | 5/456 |
| 3,199,124 | 8/1965 | Grant | 5/453 |
| 3,446,203 | 5/1969 | Murray | 5/453 |
| 3,467,081 | 9/1969 | Glass | 5/453 |
| 3,653,083 | 4/1972 | Lapidus | 5/469 |
| 3,701,173 | 10/1972 | Whitney | 5/453 |
| 3,775,781 | 12/1973 | Bruno et al. | 5/456 |
| 4,175,297 | 11/1979 | Robbins et al. | 5/453 |
| 4,267,611 | 5/1981 | Agulnick | 5/453 |
| 4,347,633 | 9/1982 | Gammons et al. | 5/453 |

FOREIGN PATENT DOCUMENTS

| | | | |
|---|---|---|---|
| 2919438 | 4/1980 | Fed. Rep. of Germany | 5/453 |

*Primary Examiner*—Alexander Grosz

*Attorney, Agent, or Firm*—Burns, Doane, Swecker & Mathis

[57] ABSTRACT

A bedsore preventing apparatus comprises an air mattress having at least two groups of pneumatically expandible and contractible cells respectively communicating with one another in each of the groups, each of said cells in one of the groups being positioned between adjacent ones of the cells in the other group, an air pump for supplying air under a pressure to the cells in each group through each of conduit pipes for the respective groups, and a valve means provided at least in one of the conduit pipes and cyclically actuated for changing over its mode between open and closed modes so that, upon activation of the apparatus, the cells in at least one of the groups sequentially expand and contact to sufficiently change inflation and deflation pattern of the cells of the air mattress for avoiding continuous support at any specific positions of patient's body lying on the mattress and preventing patient's bedsore at such positions.

2 Claims, 13 Drawing Figures

BEDSORE PREVENTING APPARATUS

TECHNICAL BACKGROUND OF THE INVENTION

This invention relates to apparatuses for preventing invalids or patients from being subjected to bedsores while they are in bed for a long and, more specifically, to a bedsore preventing apparatus wherein air supplied from an air pump to a patient-lying air mattress is cyclically changed by an air supply control means to vary body-supporting surface state of the mattress.

DISCLOSURE OF PRIOR ART

In preventing the bedsore, generally, it has been known to be effective to avoid any prolonged local contact of a patient's body with the mattress, and thus to change contacting state of the mattress for preventing a congestion from occurring locally in his body. In this case, it is also well known to be effective to supply dry air to surfaces of the mattress and the patient's body for drying the latter.

In order to realize this, there has been suggested an apparatus which comprises a plurality of air tubes arranged on a hospital bed and pneumatically coupled respectively separately to an air pump, and valve means provided to the respective air tubes for opening and closing them at different times as actuated by a proper control means, said tubes being provided respectively with small air discharge holes for supplying dry air to the patient's body surface. In the apparatus having such an arrangement, the valve means actuated will cyclically expand and contract the air tubes, and the state of bed surface can be changed to reduce the patient's bedsore. Further, the dry air supply to the patient's body surface removes its moist state, effectively to improve the bedsore preventing effect.

However, this known apparatus requires many valve means corresponding in number to the air tubes as well as many air supply tubes connecting the air pump through these valve means to the respective air tubes, which disadvantageously results in an increased number of constituent parts in a complex structure. In addition, since the small holes for supplying air to the patient's body surface are made in the surfaces of the air tubes, the patient's body surface is likely to close these small holes, and no effective moisture removal from the patient's body surface can be achieved.

There has been suggested another apparatus in U.S. Pat. No. 3,739,407 of June 19, 1973, in which air under pressure is supplied to an air mattress having a plurality of air cells, but this apparatus has been unable to provide to surface condition of the mattress of a sufficient variation for the bedsore prevention nor to supply an air stream to the patient's body surface.

DISCLOSURE OF THE INVENTION

A primary object of the present invention is, therefore, to provide a bedsore preventing apparatus which eliminates such problems as in the known apparatus. Accordingly, the apparatus is capable of remarkably reducing the number of valve means and air supply tubes to simplify its structure, increasing the function of changing the state of air mattress surface, and avoiding any blocking of small air supply holes of the mattress by the patient's body so as to effectively prevent the patient's bedsore.

In the bedsore preventing apparatus of the present invention, an air mattress is formed to have at least two groups of pneumatically expandible and contractible air cells respectively communicating with each other and preferably having an elliptic shape in section upon expansion, the cells in one of the groups are respectively disposed between adjacent ones of the cells in the other group, the respective cells in each group are coupled through a single air supply tube to an air pump, and a valve means cyclically actuated to change over its air supplying or discharging mode to the other is provided at least in one of the air supply paths which couples between the air pump and the air cells in one of the groups so as to cyclically supply and discharge air into and out of the cells, whereby the above object can be achieved. In the apparatus of the present invention, further, a group of air cells provided with small holes for discharging the supplied air directly thereout are provided to be lower in height than the expandible and contractible air cells in other groups upon their expansion.

With the apparatus of the present invention of such an arrangement, one of the valves actuated to change over to the air supplying mode causes air to be supplied from the air pump through one of the air supply tubes to the expandible and contractible air cells in one of the groups, so that the cells mutually communicating will sequentially expand from the one closest to the supply tube to the farthest one. When the valve is shifted to its air discharging mode, on the other hand, the cells are caused to sequentially contract in the order opposite to the above. Accordingly, it is made possible with the very simple arrangement to provide a favourable change in the surface state to the air mattress. Because the air cells having the small air discharge holes are of the lower height, further, the dry air can be smoothly supplied through the small holes to the patient's body surface without substantial blocking by the patient's body of the holes and the moist state of the patient's body surface can be effectively prevented.

Other objects and advantages of the present invention shall become clear from the following description of the invention detailed with reference to preferred embodiments shown in accompanying drawings.

Figure 1:
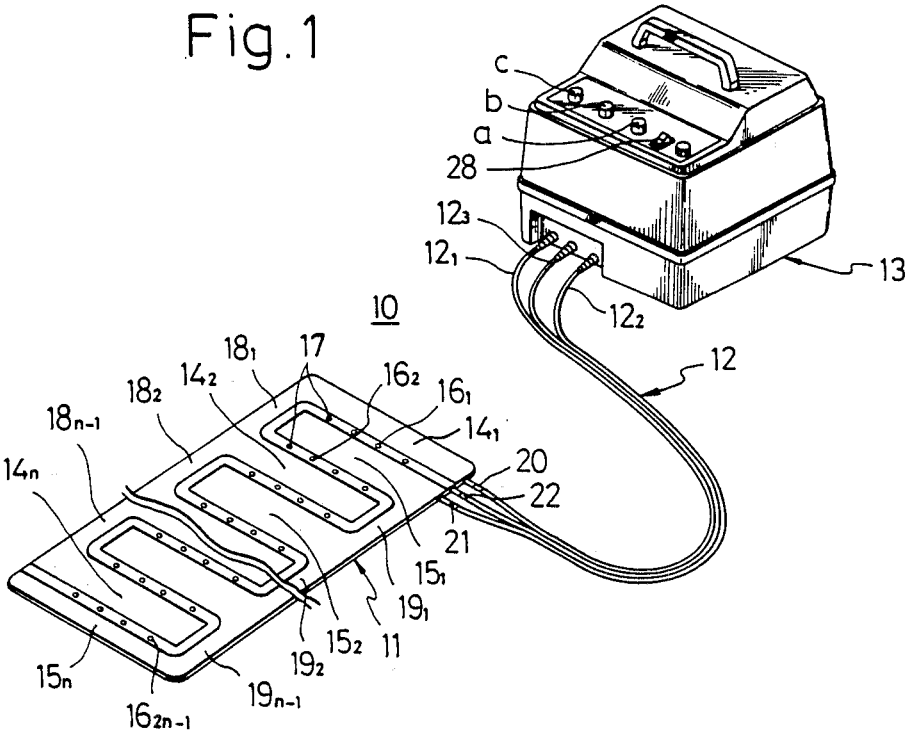
FIG. 1 is a general perspective view of the bedsore preventing apparatus according to the present invention, with the air mattress partially removed.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Figure 2:
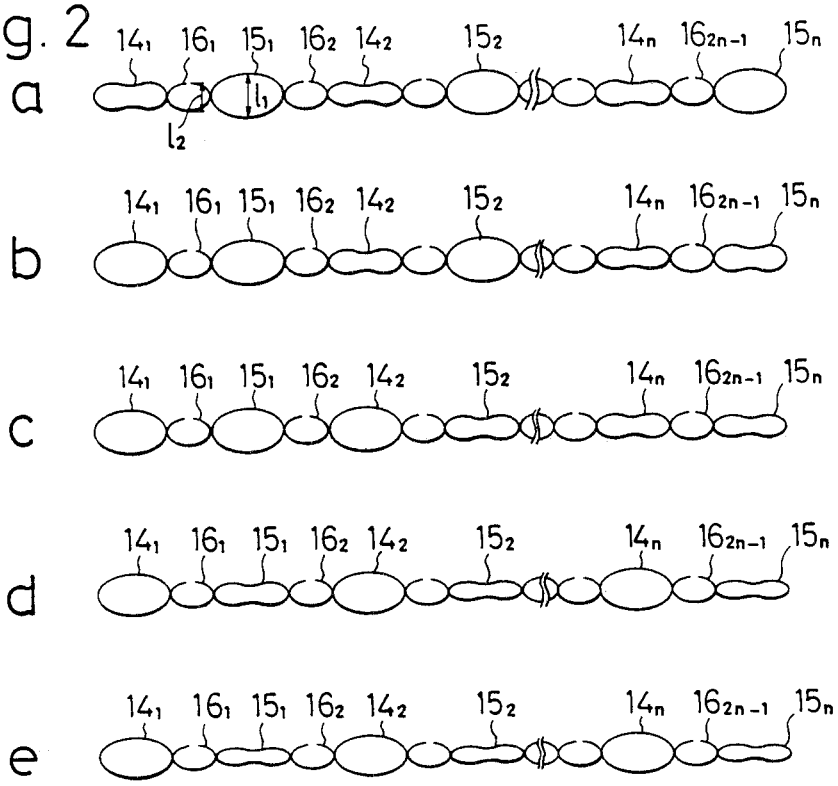
FIG. 2 schematically shows in sectioned views of the mattress in the apparatus of FIG. 1 the sequence of a typical operational pattern of the expansion and contraction of the air cells in the respective groups.
Figure 10:
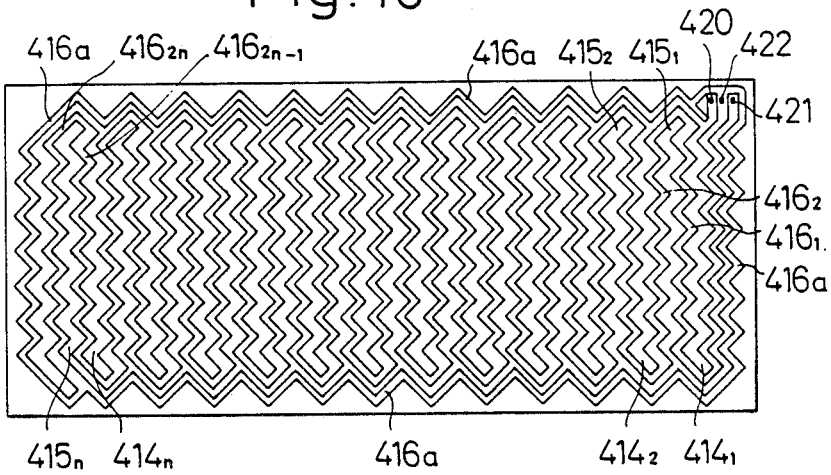
FIG. 10 is a detailed plan view similar to FIG. 8, showing another example of pattern of the air cell arrangement for use in the apparatus of FIG. 1.
Figure 9A:
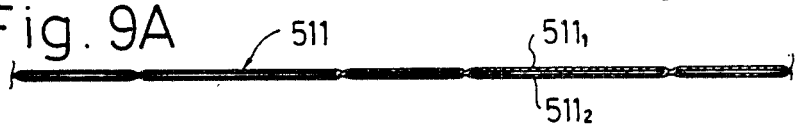
FIG. 9A is a fragmental cross section as magnified of the air mattress having an arrangement similar to that of FIG. 1, with the air cells shown in their state of contraction.
Figure 9B:
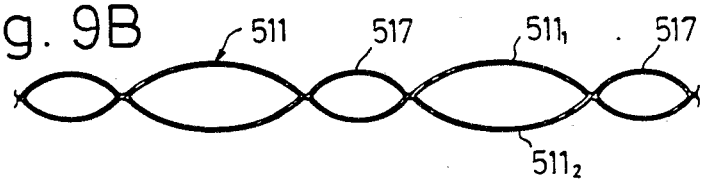
FIG. 9B is a fragmental cross section similar to FIG. 9A, but with the air cells shown in their state of expansion.

Referring to FIG. 1, a bedsore preventing apparatus 10 according to the present invention includes an air mattress 11 and an air pump assembly 13 coupled through an air supply conduit 12 to the mattress 11. More specifically, the mattress 11 is formed to have a first group of air cells $14_1$, $14_2$ . . . $14_n$, a second group of air cells $15_1$, $15_2$ . . . $15_n$ and a third group of air cells $16_1$, $16_2$ . . . $16_{2n-1}$, in which the respective groups are formed to be independent of each other, and the first and second group air cells 14 and 15 formed comb-tooth like are provided to be in mutually meshed relation and substantially symmetrical with respect to the third group of air cells 16 which are of a zigzag shape and interposed between the meshing comb-tooth like cells 14 and 15. The air mattress 11 is made of an elastic plastic or natural rubber material so that the air cells of the respective groups will be pneumatically expandible and contractible and they will be flat upon contraction but will be elliptic in section upon expansion, as seen in FIG. 2, 9A or 9B.

Further, the air cells 16 in the third group are provided so that, upon expansion, the minor axis of the ellipse of each cell in the third group will be shorter than that of the cells 14 and 15 in the first and second groups, i.e., the respective third group cells will be lower in height than the respective cells in the first or second group cells. Provided that air under a pressure of 0.03–0.20 $Kg/cm^2$ is supplied from the air pump assembly 13 to the mattress 11 and the minor axis $l_1$ of the ellipse of the first or second group cells 14 or 15 as in FIG. 2 is 100 mm, the minor axis $l_2$ of the ellipse of the third group cells 16 will be set to be about 70 mm (that is, $l_2 \approx l_1 \times 0.7$) as seen in FIG. 2. The air cells 16 in the third group extend as a whole in the lateral direction of the mattress 11 while running along a zigzag line as interposed between the air cells 14 and 15 in the first and second groups of the comb-tooth design extending also in the lateral direction of the mattress 11 as opposed to each other. The air cells 16 in the third group are provided in their upper wall with a plurality of small holes 17 for discharging air directly therethrough. In the comb-tooth design of the first or second cell groups, a series of air flow paths $18_1$, $18_2$ . . . $18_{n-1}$ or $19_1$, $19_2$ . . . $19_{n-1}$ are formed for mutual communication between the respective air cells $14_1$, $14_2$ . . . $14_n$ or $15_1$, $15_2$ . . . $15_n$ in the first and second groups, and these flow paths 18 or 19 are made to have a sectional area smaller than that of the air cells 14 and 15 in the first and second groups when they are expanded.

In the embodiment of FIG. 1, the air supply conduit 12 comprises three tubes $12_1$, $12_2$ and $12_3$, and the air cells $14_1$, $15_1$ and $16_1$ at initial position of the first, second and third groups are coupled respectively to each of these air supply tubes $12_1$, $12_2$ and $12_3$ through each of connectors 20, 21 and 22 attached to the cells on one side adjacent a longitudinal end of the mattress 11 so that each group of cells will receive air separately from the air pump assembly 13. In the present instance, the pump assembly 13 comprises preferably, as will be referred to later with reference to FIGS. 11A and 11B, a diaphragm pump having a solenoid and three solenoid valves 23 to 25 respectively corresponding to the three groups of the air cells.

Figure 3:
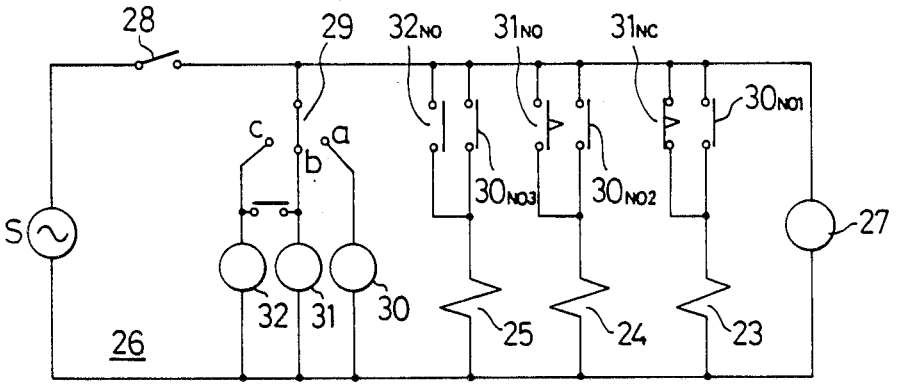
FIG. 3 is a circuit diagram of a valve control means in the apparatus of FIG. 1.

In FIG. 3, there is shown an example of control circuit 26 for the air pump assembly 13, and the circuit comprises the three solenoid valves 23 to 25, and a three-position change-over switch 29 connected in series to a power source S through a power source switch 28 to supply power to a pump 27. The change-over switch 29 has first, second and third contacts a, b and c, which are connected, respectively, to a relay 30, to a timer relay 31 having normally-closed contacts $31_{NC}$ and normally-open contacts $31_{NO}$ which are cyclically turned ON and OFF at a predetermined time interval of, e.g., 10–60 seconds, and to a relay 32 having a normally-closed contacts $32_{NC}$ through which the contact c is further connected to the timer relay 31. The three solenoid valves 23 to 25 are connected in parallel to the power source S, in such that the first valve 23 is so connected through a parallel circuit of a normally-open contacts $30_{NO1}$ of the relay 30 and the normally-closed contacts $31_{NC}$ of the timer relay 31, the second valve 24 is through a parallel circuit of a normally-open contacts $30_{NO2}$ of the relay 30 and the normally-open contacts $32_{NO}$ of the timer relay 31, and the third valve 25 is through a parallel circuit of a normally-open contacts $30_{NO3}$ of the relay 30 and a normally-open contacts $32_{NO}$ of the relay 32. When, in the control circuit 26, the change-over switch 29 is made to contact the first contact a, therefore, the normally-open contacts $30_{NO1}$, $30_{NO2}$ and $30_{NO3}$ of the relay 30 are closed simultaneously and the three solenoid valves 23 to 25 are all excited. When the switch 29 is shifted to the second contact b, the normally-closed and normally-open contacts $31_{NC}$ and $31_{NO}$ of the timer relay 31 are alternately opened and closed to alternately excite the first and second solenoid valves 23 and 24. When the switch 29 is shifted to the third contact c, the relay 32 is closed and the normally-closed and normally-open contacts $31_{NC}$ and $31_{NO}$ of the timer relay 31 are alternately opened and closed, resulting in the excitation of the third solenoid valve 25 and the alternate excitation of the first and second solenoid valves 23 and 24.

According to the bedsore preventing apparatus 10 of FIG. 1 arranged as mentioned above and incorporating such a control circuit 26 as shown in FIG. 3, the first, second and third solenoid valves 23 to 25 are provided in correspondence respectively to each of the first, second and third groups of air cells, so as to realize three operational modes. In the case where the apparatus is applied to, for example, a seriously ill patient, the power source switch 28 is turned ON and the change-over switch 29 is made to be in contact with the first contact a, then the three solenoid valves 23 to 25 operate simultaneously, whereby air under a predetermined pressure starts to be supplied to all of the air cells 14–16 in the first, second and third groups so as to achieve the first operational mode, in which the air cells 14–16 in the respective groups start to expand from the ones $14_1$, $15_1$ and $16_1$ closest to the connectors 20 to 22 sequentially to the ones $14_n$, $15_n$ and $16_{2n-1}$ furthest from the connectors to reach a fully expanded state, while a relatively small amount of air is continuously discharged out of the cells 16 through their small holes 17 of the third group. The body of the seriously ill patient lying on the air mattress 11 in this mode is supported by the larger expanded cells 14 and 15 respectively spaced by the smaller expanded cells 16, so as to reduce the area of stress imparted by the patient's own weight. A proper air ventilation, by means of the discharged air from the smaller expanded cells 16 kept away from the patient's body, is maintained so as to prevent any moist state on the contacting surface of the patient's body while patient's body will not block the small holes 17, whereby the patient's body surface can be prevented from being subjected to the bedsore.

When, on the other hand, the change-over switch 29 is shifted to the second contact b, the first and second solenoid valves 23 and 24 alternately operate at intervals of the time set by the time constant of the timer relay 31 and the air cells 14 and 15 in the first and second groups are alternately supplied with air under the predetermined pressure so as to achieve the second operational mode, in which the air cells 14 of the first group starts to expand sequentially from the one $14_1$ closest to the connector 20 gradually over to the furthest cell $14_n$, through the communication paths $18_1$ to $18_{n-1}$ of narrower width than that of the cells 14. At this time, the air cells 15 of the second group are not supplied with air. These cells 15 are originally in the expanded state after the first operation mode, the cells 15 are placed in their exhaust state so that, due to the patient's own weight and the communication paths $19_1$ to $19_{n-1}$ provided between the respective cells 15 with a narrower width than that of the cells 15, air inside these cells 15 starts to be exhausted back to the pump assembly gradually sequentially from the cell $15_n$ furthest from the connector 21 over to the closest cell $15_1$ until all of the cells 15 will be contracted. With the repetition of these gradual, sequential expansion and contraction alternately performed with respect to the first and second group air cells 14 and 15, contacting positions of the patient's body with the air mattress 11 can be sequentially varied to remarkably prevent the bedsore, while the sequential expansion and contraction of the air cells 14 and 15 can provide the same action as a light rubbing massage to promote the patient's blood circulation, so as to enhance the improvement in the bedsore prevention. During this second operational mode, the third solenoid valve 25 does not operate and the cells 16 in the third group are not supplied with air. Accordingly, this mode can be suitably applied in winter season in which the patients sweat less.

When the change-over switch 29 is further shifted to the third contact c, the third solenoid valve 25 operates to cause air always supplied through the third group cells 16 to the patient's body surface, in addition to the second operational mode, as the third operational mode of the apparatus. This third mode will be effective in summer season in which the patients sweat much, and the mode can provide dry condition to the patient's body surface.

In addition to the above three operational modes, there can be employed such a mode that the third solenoid valve 25 is operated for a limited time, suitably in, for example, spring or fall, as well as a mode in which the respective air cells throughout the three groups are operated for a limited time. In this connection, it will be readily understood that, when a microcomputer is employed in the apparatus of the present invention, the three solenoid valves 23 to 25 can be automatically sequentially controlled.

Figure 4:
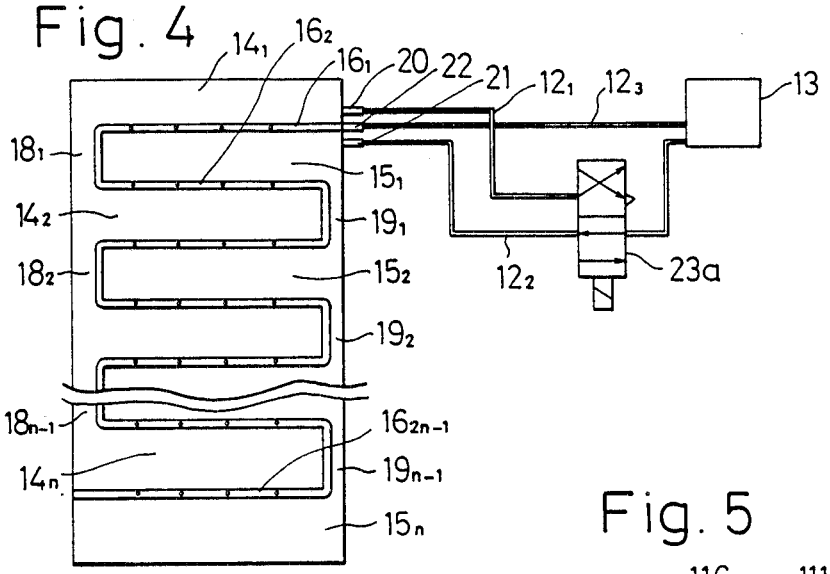
FIG. 4 is a schematic diagram of another embodiment of the apparatus employing a different type of the valve means.

According to another preferred embodiment as shown in FIG. 4 of the present invention, the third operational mode can be realized without using the control circuit of FIG. 3. In the drawing, constituent members substantially the same as those in the embodiment of FIG. 1 are denoted by the same reference numerals. In this embodiment, a solenoid-controlled two-position, four-port valve **23*a* is disposed between the air pump assembly 13 and the air supply tubes $12_1$ and $12_2$ respectively communicating with the air cells $14_1$ to $14_n$ and $15_1$ to $15_n$ in the first and second groups. Accordingly, when a valve actuating solenoid is excited at a predetermined time interval, the air cells 14 and 15** in the first and second groups will be alternately supplied with air and the smaller expansible cells $16_1$ to $16_{2n-1}$ in the third group will be always supplied with air through the air supply tube $12_3$.

Figure 5:
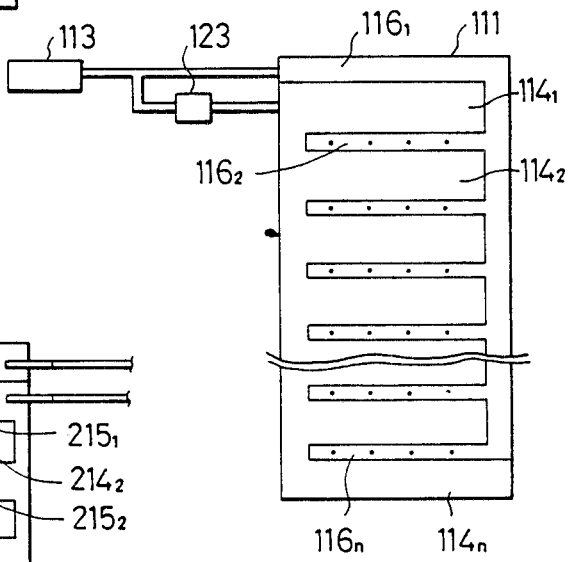
FIGS. 5 to 7 are schematic diagrams of other embodiments modified in the arrangement of the air cells in the air mattress.

According to still another feature of the present invention, the entire arrangement can be simplified to a large extent to realize an inexpensive apparatus as adapted to a single operational mode. Referring to FIG. 5, an air mattress 111 of this embodiment is formed to have a first group of air cells $114_1$, $114_2$ . . . $114_n$ similar to those in the first and second groups of FIG. 1 and a second group of air cells $116_1$, $116_2$ . . . $116_n$ similar to the ones in the third group of FIG. 1. The first group air cells 114 are coupled to an air pump assembly 113 through a solenoid valve 123 which can open and close at a predetermined time interval, and the second group air cells 116 are coupled directly to the air pump assembly 113. When the air pump in the assembly 113 and the solenoid valve 123 are operated, the first group air cells 114 will sequentially expand and contract and air will be supplied to the patient's body surface through small holes provided in the second group air cells 116, whereby an action similar to that in the above third operational mode can be obtained.

Figure 6:
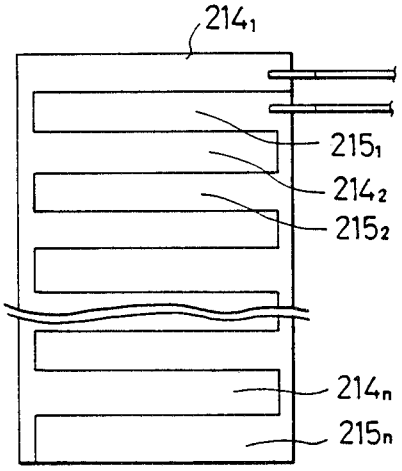
Figure 7:
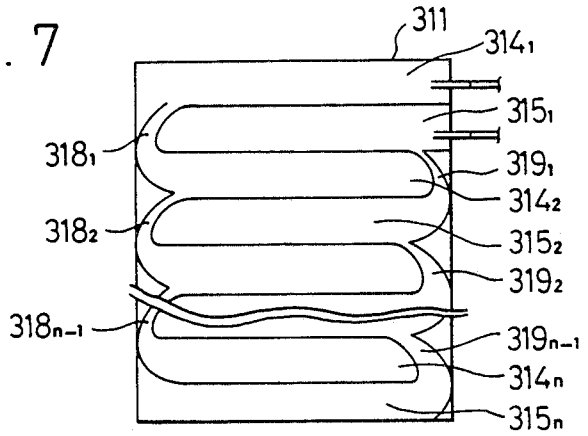

Referring to another embodiment of FIG. 6, an air mattress 211 of this embodiment is formed to have first and second groups of air cells $214_1$, $214_2$ . . . $214_n$ and $215_1$, $215_2$ . . . $215_n$ similar to the first and second group air cells in FIG. 1, and the cells in the respective groups are pneumatically coupled to an air pump assembly (not shown) through the first and second solenoid valves used in the embodiment of FIG. 1 or through the solenoid controlled four-port valve used in the embodiment of FIG. 4. According to the present embodiment, the same action as that in the foregoing second operational mode can be realized. Further, as shown in FIG. 7, when communication paths $318_1$ to $318_{n-1}$ or $319_1$ to $319_{n-1}$ which are connecting between respective first or second group air cells $314_1$, $314_2$ . . . $314_n$ or $315_1$, $315_2$ . . . $315_n$ in an air mattress 311 similar to that of FIG. 6 are arcuately curved and partially narrowed, the communication paths will increase their resistance to air flow. As a result, the first and second group air cells can expand and contract smoothly sequentially in remarkably gradual manner.

The arrangement of the communication paths in FIG. 7 can be applied not only to the embodiment of FIG. 6 but also to those in the respective embodiments of FIGS. 1, 4 and 5.

Figure 8:
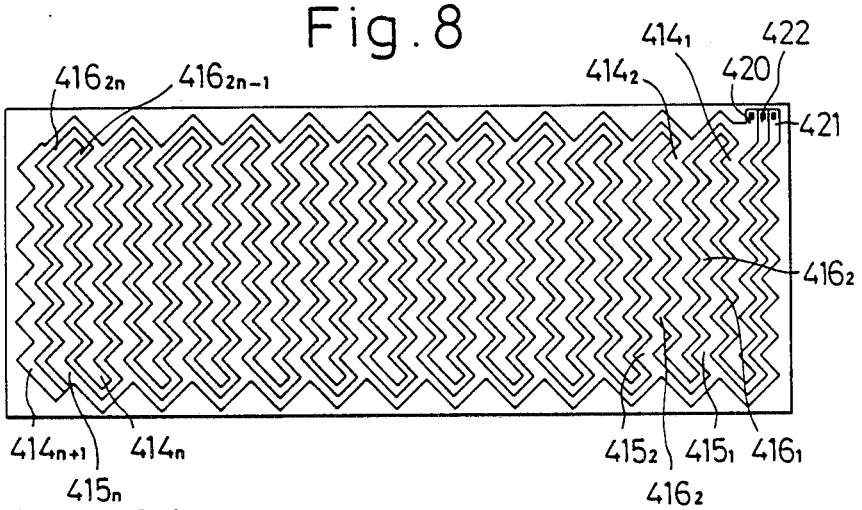
FIG. 8 is a detailed plan view in a practical example of pattern of the air cell arrangement employable in the apparatus of FIG. 1.

Though the respective embodiments described above have been schematically shown in such an extent that the technical idea of the present invention can be easily understood, it will be preferable that, in practice, each of the air cells in the respective groups of the mattress as in, for example, FIG. 1 or 4 is formed in such a zigzag pattern as shown in FIG. 8, in which respective parts corresponding to those in FIG. 1 are denoted by the same reference numerals but added by 400. The zigzag pattern of the air cells can be effectively applied to the air mattresses of the respective embodiments of FIGS. 5, 6 and 7. In this case, an air mattress 511 can be prepared to be pneumatically expandible and contractible, as shown in FIGS. 9A and 9B, by thermally fusing together two opposing sheet materials $511_1$ and $511_2$ of such a material as plastics and having a sufficient elastic property to thereby form the air cells of the respective groups in such a pattern as shown, for example, in FIG. 8.

In addition, the bedsore preventing apparatus according to the present invention may be modified in various manners. For example, in such air mattress as in FIG. 8, there is a possibility that the amount of air discharged out of the small holes provided in the furthest air cell $416_{2n}$ in the third group air cells $416_1$ to $416_{2n}$ which are of a relatively small height may happen to be decreased. However, the air discharge amount out of the small holes in the respective air cells of the third group can be made substantially constant by providing a communication path 416a which is positioned at the outermost periphery of the zigzag pattern for communication of the furthest air cell $416_{2n}$ directly with a connector 422 independently of other cells in the third group.

Figure 11A:
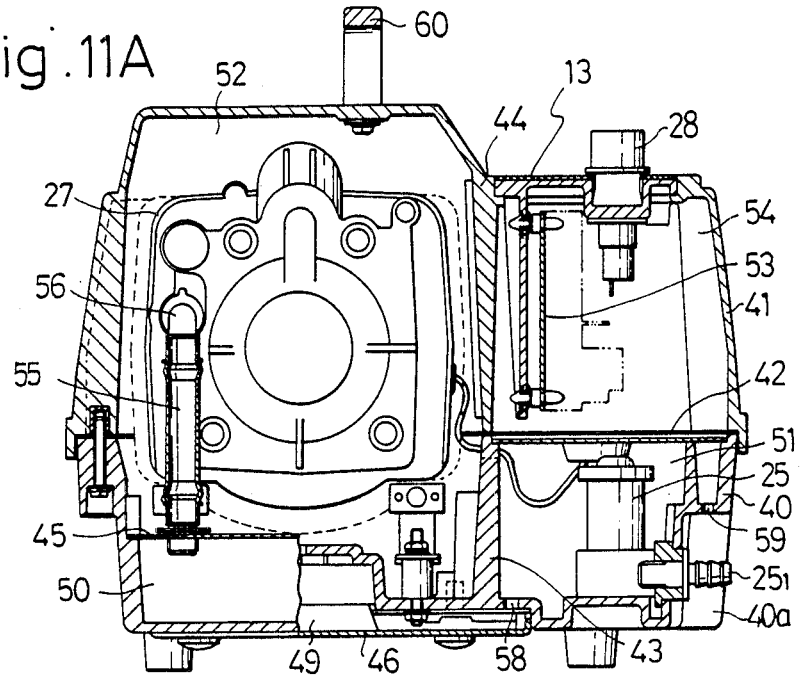
FIGS. 11A and 11B show in a practical example an air pump assembly, respectively in a vertical cross section and in a cross section with a part sectioned on a different plane.
Figure 11B:
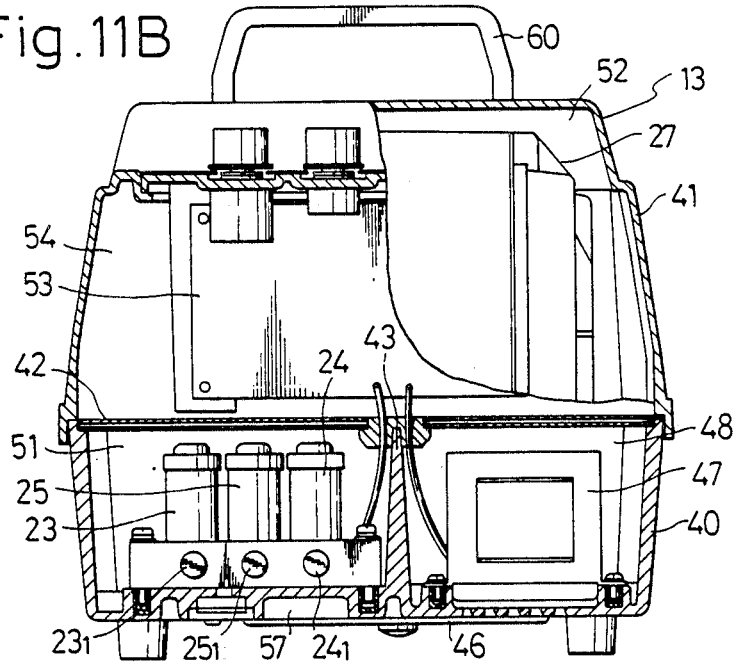

Referring now to FIGS. 11A and 11B, there is shown a typical example of the air pump assembly 13 optimumly applicable to the embodiment of FIGS. 1 to 3. In the present instance, the assembly 13 generally comprises a lower case 40 and an upper case 41 which are air-tightly coupled together, and its interior space is divided into a plurality of sections by means of a horizontal partition 42 held between the both cases 40 and 41, a cruciform partition 43 vertically erected in the lower case 40, and a transverse partition 44 vertically hung in the upper case 41. Within one of the interior sections of the lower case 40, an intermediate horizontal partition 45 is provided as spaced from the bottom of the case 40 and coupled edgewise to the horizontal partition 42 while the horizontal partition 42 is partly removed at the portion opposing the intermediate partition 45, and a lower covering 46 if fitted to the outer bottom face of the lower case 41. Inside the lower case 41 and below the horizontal partition 42, therefore, there are defined by the partitions 43 and 45 such four chambers as a chamber 48 for accommodating a transformer 47, an air cleaner chamber 49, an accumulator chamber 50 and a chamber 51 for accommodating the solenoid valves 23 to 25. Inside the upper case 41 and above the horizontal partition 42 partly including the intermediate horizontal partition 45, on the other hand, there are defined by the partition 44 such two chambers as a chamber 52 having a sound muffling function for accommodating the pump 27 and communicating with the air cleaner chamber 49, and a chamber 54 accommodating a printed circuit board 53 and the like which carries the respective electric members forming the circuit of FIG. 3 and holding the switches 28 and 29 to which the members are connected, the chamber 54 communicating with the valve accommodating chamber 51.

The accumulator chamber 50 specifically is formed to be air-tight and communicates through a pipe 55 with an air blow-out port 56 of the pump 27 and through a communicating path 57 with air-intake ports of the respective solenoid valves 23 to 25 in the chamber 51. These valves 23 to 25 are respectively provided with each of connecting ports $23_1$, $24_1$ and $25_1$ connected to the air supply conduit pipes $12_1$, $12_2$ and $12_3$ as in FIG. 1, and these connecting ports are exposed out of the lower case 40 at a recess 40a formed in a front lower corner of the case. The valve accommodating chamber 51 is made to communicate through a communicating path 58 with the air cleaner chamber 49 which per se communicating with the chamber 52 and through the chamber 54 and an air inlet port 59 with the atmosphere. On the top of the upper case 41, further, a gripping handle 60 is secured for an easy carrying of the assembly.

With the above arrangement, the pump 27 actuated causes air to be taken into the pump-accommodating chamber 52 through the inlet port 59, chambers 54 and 51 and air cleaner chamber 49. Air led through an intake port into the pump 27 is compressed therein, and the compressed air is fed through the blow-out port 56, pipe 25, accumulator chamber 50 and communicating path 57 to the solenoid valves 23 to 25 in the chamber 51, for supplying air to the air supply conduit pipes $12_1$ to $12_3$. The respective solenoid valves are optimumly controlled by the circuit of FIG. 3 and on the printed circuit board 53, and the desired operation in such modes as has been referred to with reference to the foregoing embodiments will be achieved. As the printed circuit board 53 is disposed in the chamber 54 which forming a part of air-flow path towards the pump 27, the respective electric members on the board can be effectively cooled by the intake air flow so that any misoperation of the control circuit for the valves due to any overheating can be prevented.

According to the bedsore preventing apparatus of the present invention arranged as has been described, the valve means and air supply conduit pipes can be greatly reduced in number with a remarkably simple arrangement, effective state change can be provided to the surface of the air mattress, and air can be discharged out of the relatively smaller air cell group without any blocking by the patient's body of the air discharging holes, so that the bedsore preventing effect can be remarkably improved.

What is claimed as our invention is:

1. A bedsore preventing apparatus comprising:

an air mattress including first, second and third independent groups of air cells defined in said mattress, said air cells in each of said first and second groups respectively interdigitating wherein one end of each air cell meshes with respective air cells in the other group so that air cells from both groups mesh with each other in comb-tooth-like relationship, and said air cells in said third group being disposed to extend continuously in zigzag form between respective said interdigitating first and second group air cells, and being formed to have a height smaller than that of the first and second group air cells and a plurality of small holes made in the top surface of said air cells in said third group, and first and second communication paths respectively including arcuately bent portions generally of a height smaller than said first and second group air cells each of which portions connect the other ends of adjacent two of said interdigitating air cells in each of the first and second groups;

first, second and third air supply paths respectively connected at one end to an end of each of said first, second and third air cell groups;

first and second valve means provided respectively in each of said first and second air supply paths and actuatable to change over operating state of supplying and discharging air through the supply paths into and out of the first and second air cell groups;

means including an electric control circuit connected to said first and second valve means for controlling cyclically alternately said actuation of each of said first and second valve means; and means including an air pump connected to the other ends of said first to third air supply paths for supplying therethrough pressurized air to said first and second groups of air cells for their alternate and sequential expansion and contraction due to said alternate actuation of said first and second valve means, and to said third group of air cells for discharging the air through said small holes, said air supplying means comprising a housing having therein at least first, second and third chambers respectively accommodating each of said air pump, control circuit and first and second valve means, said second chamber forming part of an air intake path from the exterior of said housing to the air pump in said first chamber, while said first and third chambers communicate with each other to form an airblowing path from the pump to the valve means.

2. An apparatus according to claim 1, which further comprises a third valve means provided in said third air supply path and actuatable to change over operating state of opening and closing the third air supply path, said controlling means being connected to said third valve means for controlling said actuation thereof so that said alternate expansion and contraction of said first and second air cell groups can be made in one of two modes of with and without said air discharging of the third air cell group.

* * * * *